US005735342A

United States Patent [19]

Nitta

[11] Patent Number: 5,735,342

[45] Date of Patent: Apr. 7, 1998

[54] HEAT EXCHANGER

[76] Inventor: Minoru Nitta, 2207 Laurel Way, Upland, Calif. 91784

[21] Appl. No.: 649,467

[22] Filed: May 17, 1996

[51] Int. Cl.[6] ..... F28D 7/10

[52] U.S. Cl. ..... 165/122; 165/121; 165/155; 165/179; 165/DIG. 305; 165/DIG. 316

[58] Field of Search ..... 165/120–122, 165/154, 155, 179

[56] References Cited

U.S. PATENT DOCUMENTS

| | | | |
|---|---|---|---|
| 1,529,190 | 3/1925 | Kettering | 165/155 |
| 1,881,771 | 10/1932 | Lyman | 165/155 X |
| 3,120,868 | 2/1964 | Ballantine | 165/155 |
| 4,004,634 | 1/1977 | Habdas | 165/155 |
| 4,505,326 | 3/1985 | Hazen | 165/45 |
| 4,862,955 | 9/1989 | Itakura | 165/155 |
| 5,529,118 | 6/1996 | Nitta | 165/148 |

FOREIGN PATENT DOCUMENTS

| | | | |
|---|---|---|---|
| 758810 | 1/1934 | France | 165/155 |
| 37440 | 4/1986 | Germany | 165/155 |

*Primary Examiner*—Allen J. Flanigan
*Attorney, Agent, or Firm*—Lyon & Lyon LLP

[57] ABSTRACT

A heat exchanger system including an outer duct housing a powered fan at one end. A heat exchanger is positioned in line with the fan within the duct and includes two nested pipes. Each pipe includes radially outward fins and radially inward fins. The radially inward fins on the outer pipe and the radially outward fins on the inner pipe are interdigitated. Appropriately positioned radial dividers extend fully between the bodies of the two pipes to divide the space between pipes into segments. End caps placed on the ends of the pipes include baffles which appropriately divide annular manifolds defined between the pipes and between the ends of the fins and the end caps in order that four passes are possible through the length of the heat exchanger. The radial dividers may be asymmetrically positioned to accommodate changes in volume with condensation of the fluid passing between the inner and outer pipes.

13 Claims, 6 Drawing Sheets

HEAT EXCHANGER

BACKGROUND OF THE INVENTION

The field of the present invention is fluid-to-fluid heat transfer mechanisms including condensers.

Heat exchangers have long been available which operate to transfer heat energy between fluids on either side of a highly conductive barrier. To increase the transfer rate, various configurations have been employed to increase the surface area of the highly conductive barrier relative to the cross-sectional area of the flow. Pipes, fins and baffles contribute to increased heat transfer across such barriers between fluids. Such structures can become highly complicated and difficult to fabricate. Further, thermal stresses and thermal transients must be accommodated.

SUMMARY OF THE INVENTION

The present inventions is directed to a heat exchanger of compact and simple construction with a high ratio of surface area to flow cross-sectional area.

In a first, separate aspect of the present invention, two pipes are arranged one within the other. Each pipe includes both inner and outer radially extending fins which also extend longitudinally of each pipe. The adjacent fins between pipes are interdigitated to define a complex chamber between the pipes.

In a second, separate aspect of the present invention, the foregoing structure may further include radial dividers which extend fully between the pipes so as to divide the volume into two or more segments. The segments may be connected in series with the dividers being asymmetrically placed to accommodate volume changes with condensation of flow as it passes through the heat exchanger.

In a third, separate aspect of the present invention, the structure of the first aspect may employee end caps including channels receiving the ends of the pipes. The fins may be appropriately displaced inwardly from the ends of the pipes such that a manifold is defined inwardly of the end cap and between the pipes.

In a further, separate aspect of the present invention, any of the foregoing aspects may further include a passage through the center of the heat exchanger with holes in the end caps. Ducting and fans may further enhance air flow both through the passage and around the periphery of the outer pipe.

Accordingly, it is an object of the present invention to provide an improved heat exchanger. Further objects and advantages will appear hereinafter.

DETAILED DESCRIPTION OF THE PREFERRED EMBODIMENT

Figure 1:
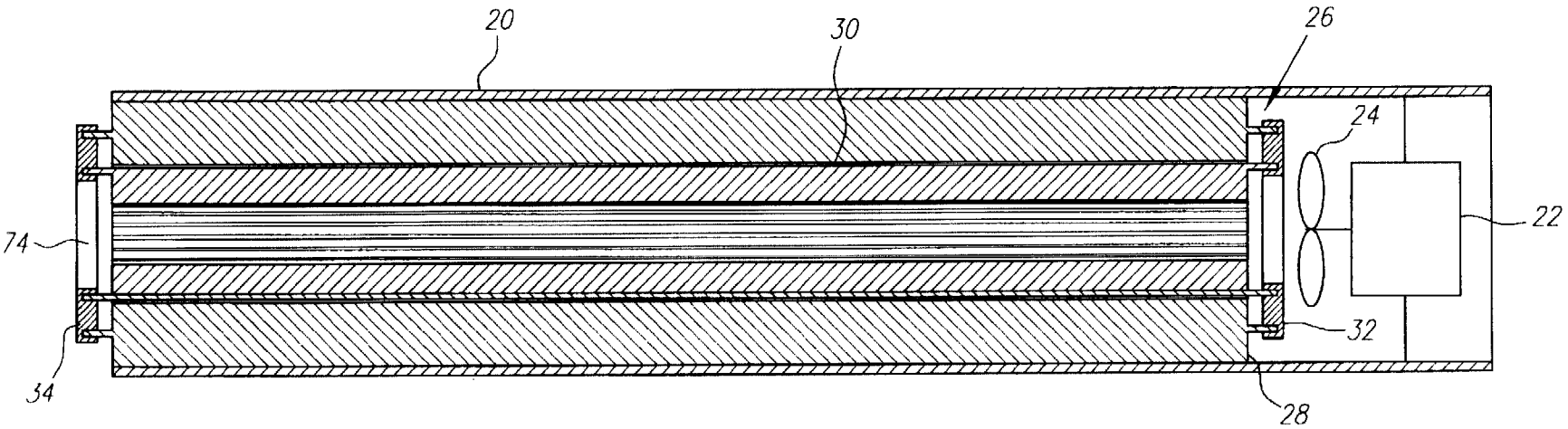
FIG. 1 is a cross-sectional side view of a heat exchanger.

Turning in detail to the drawings, FIG. 1 illustrates an assembled heat exchanger illustrated in cross section. FIGS. 2 through 11 illustrate the components making up this heat exchanger. FIG. 12 illustrates the nesting arrangement of the inner and outer pipes.

The heat exchanger includes a surrounding duct 20 which may be square in cross section. A motor 22 is mounted within one end of the duct 20 and drives a fan 24. Within the duct 20 is the heat exchange device, generally designated 26. The heat exchange device 26 is comprised of an outer pipe 28, an inner pipe 30 nested within the outer pipe 28 and two end caps 32 and 34.

Figure 2:
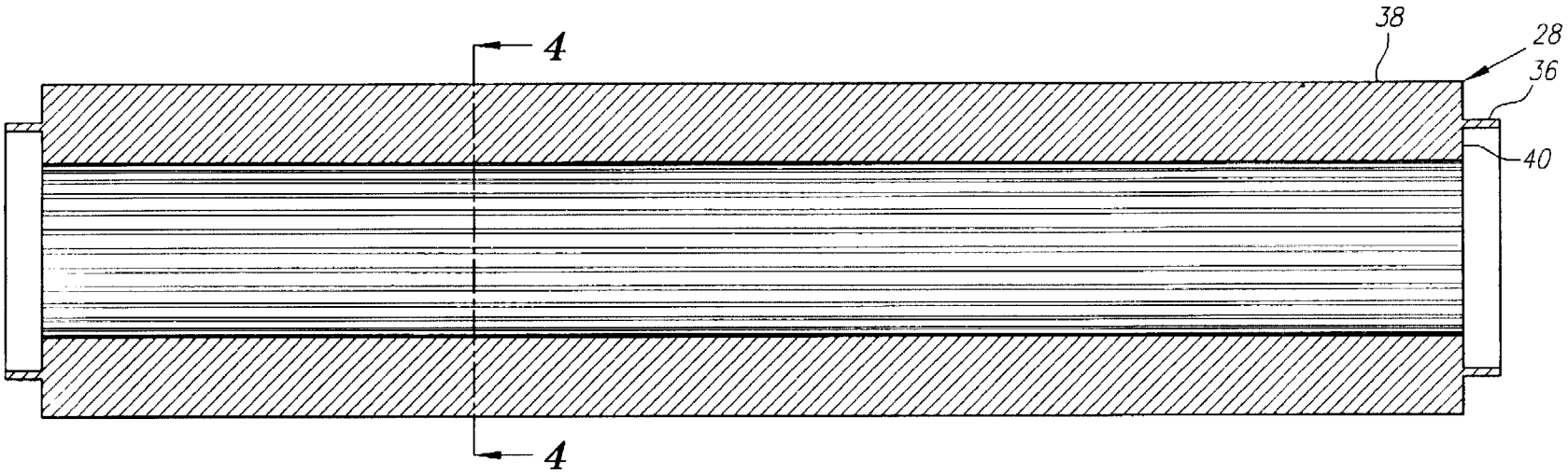
FIG. 2 is a cross-sectional side view of the outer pipe.
Figure 4:
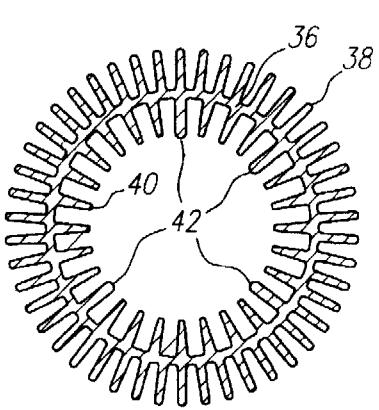
FIG. 4 is a cross-sectional view taken along line 4—4 of FIG. 2.
Figure 3:
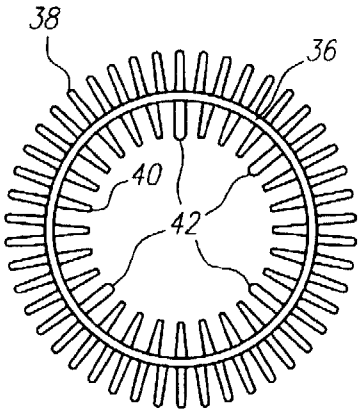
FIG. 3 is an end view of the pipe of FIG. 2.

The outer pipe 28 is best illustrated in FIGS. 2, 3 and 4. The outer pipe 28 has a cylindrical body 36. Radially outward fins 38 are positioned about the cylindrical body 36. In the illustrated embodiment, forty-six such fins are employed. These fins 38 extend parallel to the longitudinal axis of the cylindrical body 36. Further, the outward fins 38 are shown not to extend fully to the ends of the cylindrical body 36 inwardly of the cylindrical body 36 there are radially inward fins 40 also extending longitudinally of the cylindrical body 36. In this embodiment, there are twenty-four such radially inward fins 40. The radially inward fins 40, like the radially outward fins 38, do not extend fully to the ends of the cylindrical body 36. Placed among the radially inward fins 40 are radial dividers 42. There are four such dividers illustrated in FIGS. 3 and 4. These dividers are shown to be larger and longer than the fins 40.

Figure 5:
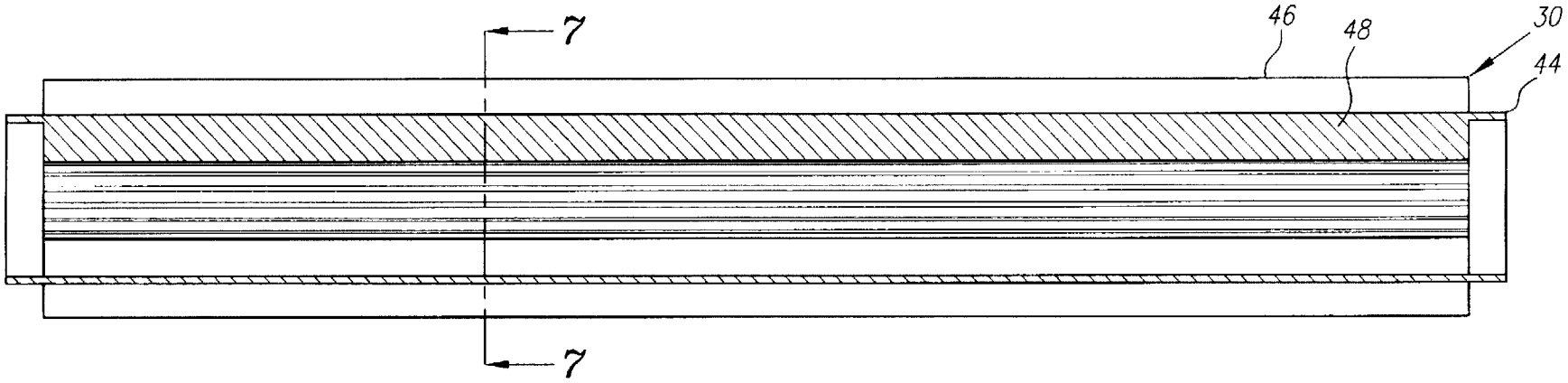
FIG. 5 is a cross-sectional side view of the inside pipe.
Figure 7:
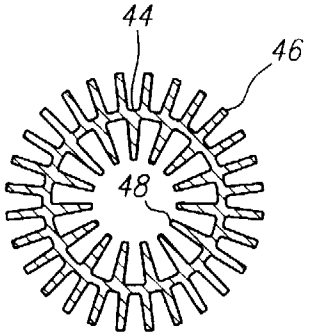
FIG. 7 is a cross-sectional view taken along line 7—7 of FIG. 5.
Figure 6:
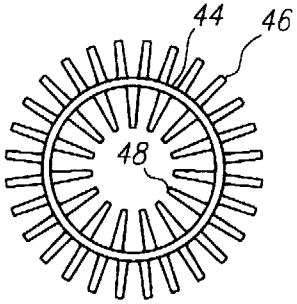
FIG. 6 is an end view of the inside pipe of FIG. 5.

The inner pipe 30 is best illustrated in FIGS. 5, 6 and 7. The inner pipe 30 also includes a cylindrical body 44 with radially outward fins 46 and radially inward fins 48. Again, the fins 46 and 48 do not extend fully to the ends of the cylindrical body 44. In this embodiment, there are twenty-eight such radially outward fins 46 and fifteen radially inward fins 48. These fins 46 and 48 are also arranged parallel to the longitudinal axis of the inner pipe 30.

Figure 9:
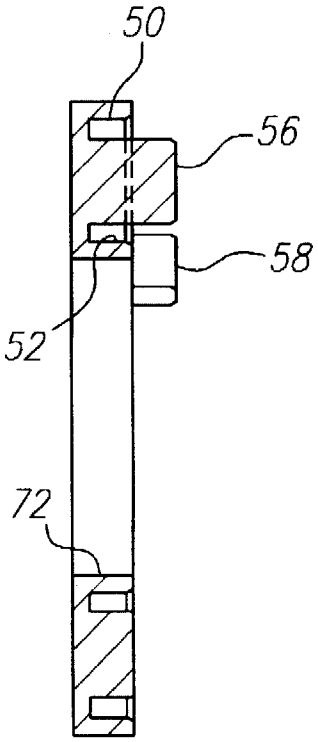
FIG. 9 is a cross-sectional side view of the end cap of FIG. 8 taken along line 9—9 of FIG. 8.
Figure 8:
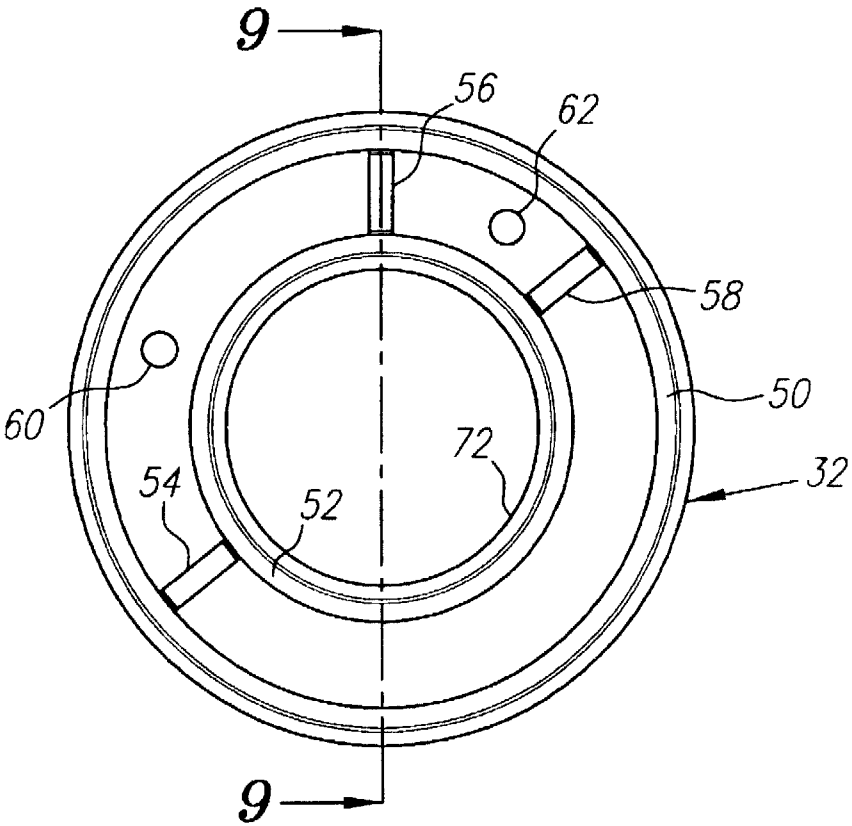
FIG. 8 is a plan view of a first end cap.

FIGS. 8 and 9 illustrate the first end cap 32. The end cap 32 has an outer circular channel 50. The outer circular channel 50 receives one end of the outer pipe 28. An inner circular channel 52 receives one end of the inner pipe 30. Baffles 54, 56 and 58 extend radially on the end cap 32 between the channels 50 and 52. An inlet port 60 and an outlet port 62 are appropriately arranged between the baffles as seen in FIG. 8.

Figure 11:
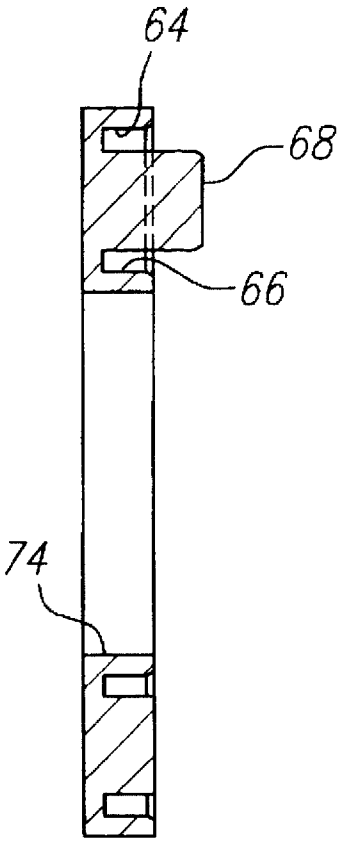
FIG. 11 is a cross-sectional side view of the end cap of FIG. 10 taken along line 11—11 of FIG. 10.
Figure 10:
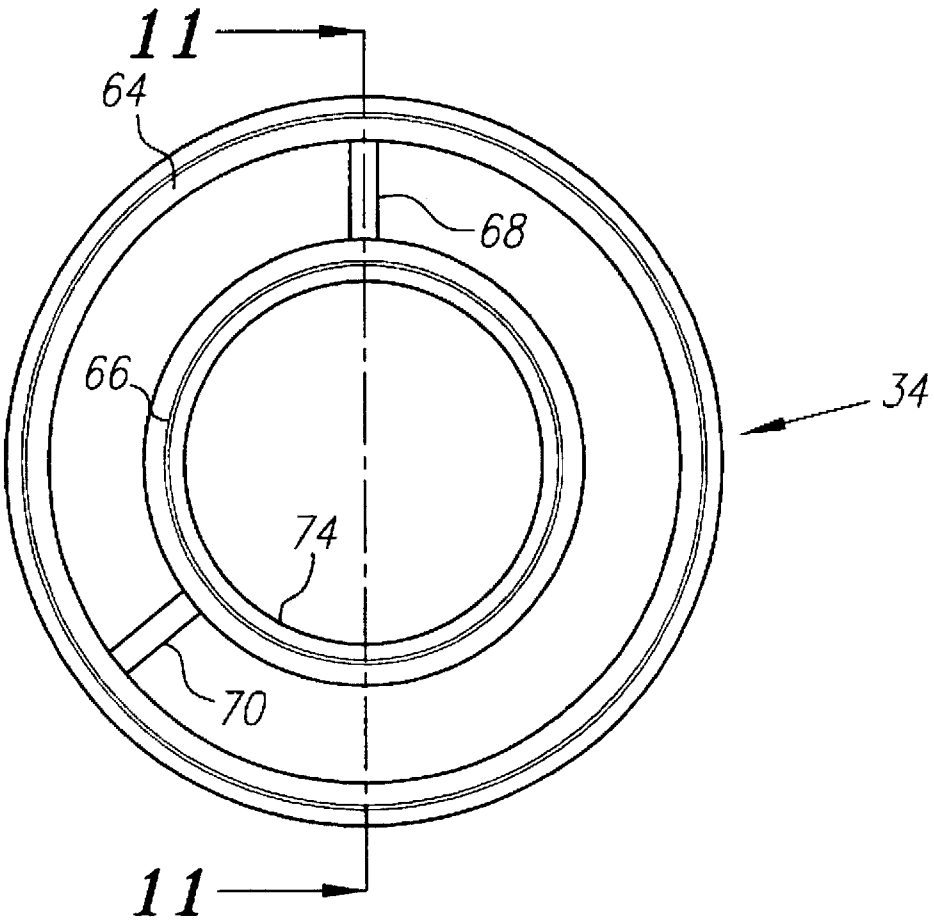
FIG. 10 is a plan view of a second end cap.
Figure 12:
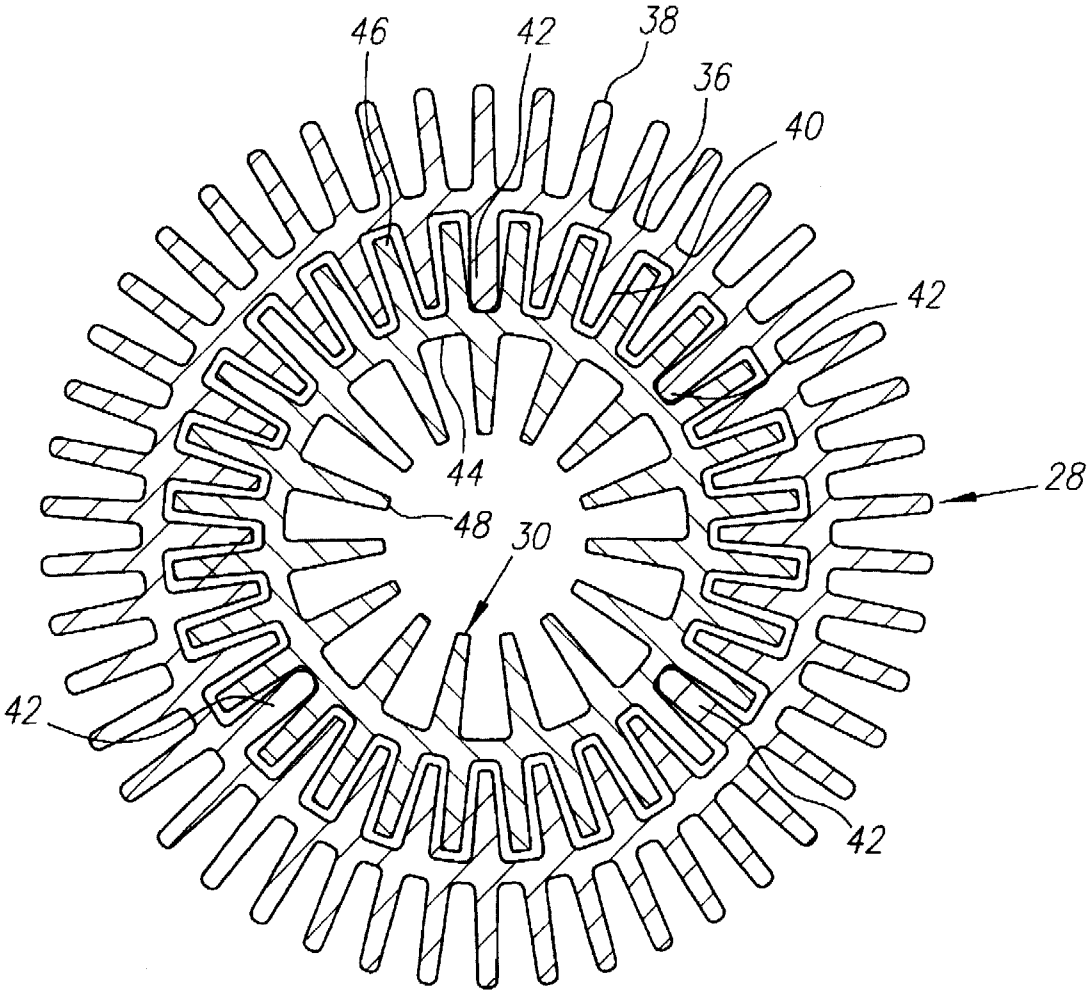
FIG. 12 is a cross-sectional view taken normal to the longitudinal axis of the inner and outer pipes with the pipes in nested relationship.

FIGS. 10 and 11 best illustrate the end cap 34. It is similarly constructed to the end cap 32 with circular channels 64 and 66. Two baffles 68 and 70 extend between the circular channels 64 and 66.

The inner pipe 30 defines an inner passage through the center of the pipe. The radially inward fins 48 extend into that passage. The two end caps 32 and 34 have holes 72 and 74 which align with the passage through the inner pipe 30. In this way, the fan 24 can force air through the interior of the heat exchanger as well as outwardly around the heat exchanger with flow in the longitudinal direction of the device.

FIG. 12 illustrates the nesting arrangement of the outer pipe 28 and the inner pipe 30. It is shown that between the radial dividers 42, the pipes, including the fins, are uniformly spaced apart with the radially inward fins 40 and the radially outward fins 46 being interdigitated. The radial dividers 42 are also shown to extend fully to the inner pipe 30, encountering the cylindrical body 44. The baffles 54, 56, 58, 68 and 70 all appropriately align with the radial dividers 42 to establish series circulation through the several segments between dividers 42.

One or both pipes 28 and 30 may include surface treatment such as slots or roughened surfaces on the fins to modify the flow and enhance heat transfer. Of course, the spacing between pipes, the size and proportions of the heat exchanger, materials employed and other conventional techniques may be used to enhance utility in any given application.

In construction of the heat exchanger, the outer pipe 28 and the inner pipe 30 may individually be made as single extrusions. The ends of the fins would then be trimmed to create annular manifold segments between baffles. A solid solder sheet may be placed over the ends of each of the pipes 28 and 30 before assembly of the end caps 32 and 34 with the pipes. The structure may then be heated to fully seal and position the end caps 32 and 34 on the pipes 28 and 30. Thus, through a minimal amount of assembly, an advantageous flow path is created.

Thus, a heat exchanger is disclosed having four principal components defining the interior flow path. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A heat exchanger comprising a first pipe having a longitudinal axis, first radially outward fins extending parallel to the longitudinal axis and first radially inward fins extending parallel to the longitudinal axis;

a second pipe positioned in the first pipe along the longitudinal axis, and having second radially outward fins extending parallel to the longitudinal axis and second radially inward fins extending parallel to the longitudinal axis, the first radially inward fins and the second radially outward fins being interdigitated;

first and second end caps extending between the first and second pipes at the ends thereof, respectively;

radial dividers extending between the first pipe and the second pipe and parallel to the longitudinal axis.

2. The heat exchanger of claim 1, the first radially outward fins, the first radially inward fins, the second radially outward fins and the second radially inward fins terminating inwardly of the ends of the first and second pipes, respectively, the first and second end caps each having circular channels facing the first and second pipes and receiving the ends thereof and being displaced from the second radially outward and the first radially inward fins.

3. The heat exchanger of claim 2, the end caps further having at least one baffle extending to one of the radial dividers.

4. The heat exchanger of claim 1, the radial dividers being asymmetrically placed to accommodate volume changes with condensation of flow between the first and second pipes.

5. The heat exchanger of claim 1, the first pipe and the second pipe being spaced apart a uniform distance between the radial dividers.

6. A heat exchanger comprising a first pipe having a longitudinal axis, first radially outward fins extending parallel to the longitudinal axis and first radially inward fins extending parallel to the longitudinal axis;

a second pipe positioned in the first pipe along the longitudinal axis, and having second radially outward fins extending parallel to the longitudinal axis and second radially inward fins extending parallel to the longitudinal axis, the first radially inward fins and the second radially outward fins being interdigitated;

first and second end caps extending between the first and second pipes at the ends thereof, respectively, the first and second end caps each having a hole inwardly of the circular channels aligned with the inside of the second pipe, the second pipe, the first end cap and the second end cap defining a central passage open at both ends, the second radially inward fins extending into the central passage.

7. The heat exchanger of claim 6 further comprising a duct surrounding the first pipe and open at both ends;

a fan mounted in the duct.

8. The heat exchanger of claim 1, the first pipe, the first radially inward fins and the first radially outward fins being a single extrusion, the second pipe, the second radially inward fins and the second radially outward fins being a single extrusion.

9. A heat exchanger comprising a first pipe having a first cylindrical body, a longitudinal axis, first radially outward fins from the first cylindrical body extending parallel to the longitudinal axis and first radially inward fins from the first cylindrical body extending parallel to the longitudinal axis, the first radially outward fins and the first radially inward fins terminating inwardly of the ends of the first cylindrical body;

a second pipe positioned in the first pipe along the longitudinal axis and having a second cylindrical body, second radially outward fins from the second cylindrical body extending parallel to the longitudinal axis and second radially inward fins from the second cylindrical body extending parallel to the longitudinal axis, the first radially inward fins and the second radially outward fins being interdigitated and longitudinally coextensive, the first cylindrical body and the second cylindrical body being longitudinally coextensive;

first and second end caps extending between the ends of the first and second cylindrical bodies, respectively, and having circular channels facing the first and second pipes and receiving the ends of the first cylindrical body and the second cylindrical body, respectively, the first and second end caps being displaced from the second radially outward and the first radially inward fins.

10. The heat exchanger of claim 9, the first pipe and the second pipe being spaced apart a uniform distance.

11. The heat exchanger of claim 9, the first and second end caps each having a hole inwardly of the circular channel aligned with the inside of the second pipe, the second pipe, the first end cap and the second end cap defining a central passage open at both ends, the second radially inward fins extending into the central passage.

12. The heat exchanger of claim 11 further comprising a duct surrounding the first pipe and open at both ends;

a fan mounted in the duct.

13. The heat exchanger of claim 9, the first pipe, the first radially inward fins and the first radially outward fins being a single extrusion, the second pipe, the second radially inward fins and the second radially outward fins being a single extrusion.

* * * * *